United States Patent [19]

Bronkal

[11] Patent Number: 5,048,488

[45] Date of Patent: Sep. 17, 1991

[54] METHOD AND APPARATUS FOR REDUCING THE RESIDUAL INJECTION FLUID IN AN INJECTION PUMP

[75] Inventor: Bernhard Bronkal, Koengen, Fed. Rep. of Germany

[73] Assignee: Robert Bosch GmbH, Stuttgart, Fed. Rep. of Germany

[21] Appl. No.: 629,144

[22] Filed: Dec. 18, 1990

[30] Foreign Application Priority Data

Feb. 27, 1990 [DE] Fed. Rep. of Germany ..... 4006084

[51] Int. Cl.[5] ..... F02M 41/00

[52] U.S. Cl. ..... 123/467; 123/502; 123/198 DB

[58] Field of Search ..... 123/502, 449, 198 D, 123/179 L, 467, 198 DB

[56] References Cited

U.S. PATENT DOCUMENTS

| | | | |
|---|---|---|---|
| 4,262,645 | 4/1981 | Kobayashi | 123/179 L |
| 4,354,474 | 10/1982 | Kobayashi | 123/179 L |
| 4,458,648 | 7/1984 | Braun | 123/449 |
| 4,462,361 | 7/1984 | Karle | 123/502 |
| 4,470,397 | 9/1984 | Brotherston | 123/198 D |
| 4,470,763 | 9/1984 | Yasuhara | 123/449 |
| 4,520,780 | 6/1985 | Ito | 123/198 DB |
| 4,541,392 | 9/1985 | Ogino | 123/502 |
| 4,565,170 | 1/1986 | Grieshaber et al. | 123/359 |
| 4,597,369 | 7/1986 | Yasuhara | 123/198 DB |
| 4,969,442 | 11/1990 | Tave | 123/467 |

*Primary Examiner*—Carl Stuart Miller

*Attorney, Agent, or Firm*—Kenyon & Kenyon

[57] ABSTRACT

A method and apparatus reduces the amount of residual injection fluid within an injection pump. When an associated internal combustion engine is shut off, a stop valve in the injection pump is closed and an injection timing mechanism is shifted into an early position after a predetermined waiting time has expired. The length of the waiting time is selected in order to enable the injection fluid already supplied to the pump at the instant that the stop valve is closed, to enter the interior of the pump while the injection timing mechanism is in an existing working position.

9 Claims, 2 Drawing Sheets

METHOD AND APPARATUS FOR REDUCING THE RESIDUAL INJECTION FLUID IN AN INJECTION PUMP

BACKGROUND INFORMATION

The present invention relates to methods and apparatus for reducing the amount of residual injection fluid within an injection pump after an associated internal combustion engine is shut off. More particularly, the present invention relates to methods and apparatus for reducing amount of the residual injection fluid within a distributor injection pump including an injection timing mechanism, after a stop valve, such as an electro-magnetic stopping device, on the pump is closed.

The present invention is mainly concerned with distributor injection pumps. A distributor injection pump has only one pumping element for all of the cylinders of an internal combustion engine. A piston in the distributor injection pump delivers the fuel via a lifting movement and distributes it to individual outlets via a rotary motion. During one revolution of the piston around a driving shaft, the piston executes as many strokes as there are engine cylinders to supply.

One disadvantage associated with distributor injection pumps is that even though an electrical stop valve (such as an "ELAB") shuts off the internal combustion engine, a significant amount of residual fuel is still injected. This condition can lead to engine damage and accidents. This condition is typically caused by the collection of fuel within the reset area of the pump during the "bottom dead-point movement" (UT-movement) of the pump's piston upon the closure of the stop valve. The quantity of fuel collected depends on the time cross-section of the reset area, which varies with rotational speed, with the instant that the delivery of fuel ends, with the configuration of the reset area, and with the prevailing pressure in the interior space of the pump.

German Published Patent Application No. 33 04 335 discloses a control system for stopping the operation of an internal combustion engine. In normal operation, fuel is sucked in from a fuel tank and directed to the suction chamber of an injection pump via a delivery pipe. A separate suction device is provided to shut off the internal combustion engine. The separate suction device is connected on its suction side to the suction chamber of the injection pump. The suction device aspirates the fuel from the suction chamber when the operation of the internal combustion engine is stopped.

ADVANTAGES OF THE INVENTION

One advantage of the method of the present invention is that the precise and reliable stoppage of an internal combustion engine is substantially guaranteed. As a result of the measures of the present invention, the residual quantity of injection fluid is reduced to such an extent that, independent of the existing operating point, a perfect stoppage of the engine always takes place. By shifting the injection timing mechanism into the early position after the stop valve is closed, considerable quantities of fuel from the interior of the pump are prevented from penetrating through the reset area to the piston/cylinder unit (ELAB outer chamber $V_2$). In this manner, the residual injection quantity is decisively reduced.

According to a preferred embodiment of the present invention, after the stop valve is closed, the injection timing mechanism is shifted into the early position only upon the expiration of a waiting time period.

The length of the waiting time period is preferably selected in order to enable the fuel already supplied to the cylinders of the internal combustion engine upon the closing of the stop valve, to be consumed in the existing working position of the injection timing mechanism. Only upon the expiration of the waiting time period does the injection timing mechanism assume its early position. The result is that any combustion of fuel in the early position of the injection timing mechanism is essentially avoided; consequently, there is no harsh engine noise or accompanying mechanical stress, as normally occurs in this early position. The waiting time period is preferably within the range of approximately 200 to 300 ms.

The present invention is also directed to an injection pump, in particular a distributor injection pump, provided with an injection timing mechanism and a stop valve. The stop valve is closed when an associated internal combustion engine is shut off, whereby after the stop valve is closed, the injection timing mechanism assumes its early position.

DETAILED DESCRIPTION

Figure 1:
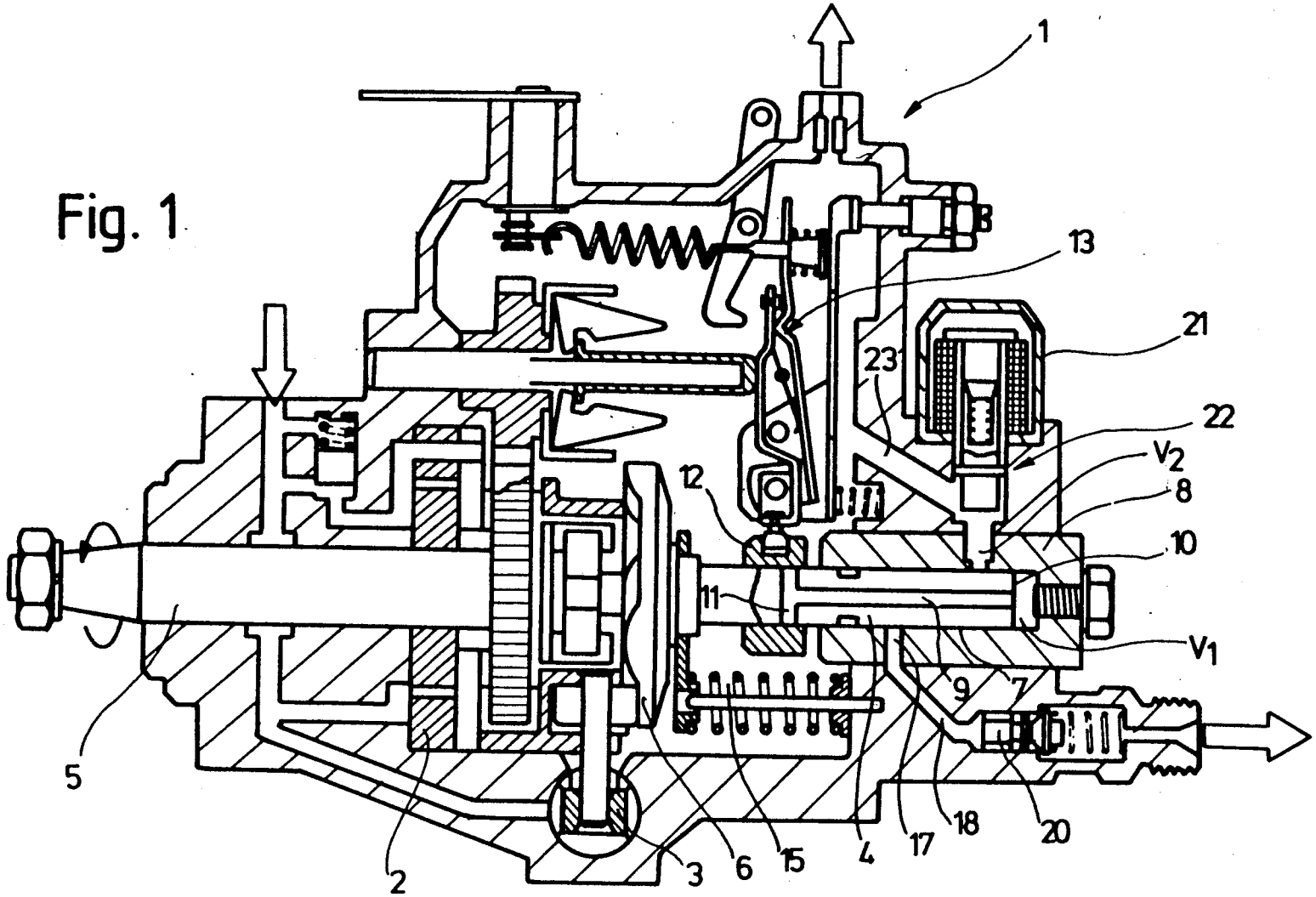
FIG. 1 is a cross-sectional view of a distributor injection pump embodying the present invention.

Referring to FIG. 1, a distributor injection pump embodying the present invention is indicated generally by the reference numeral 1. The distributor injection pump 1 includes an integrated sliding-vane discharge pump 2 for the supply of fuel. An injection timing mechanism 3 controls the subsequent injection of the fuel into an internal combustion engine (not shown). With the help of the timing mechanism 3 and in view of a reference point, such as the upper dead point (OT) of a distributor piston 4, either an early or a late adjustment can be performed. The fuel is accordingly injected either at an earlier or a later point in time.

The distributor piston 4 is actuated by means of a cam plate 6 which is driven by a driving shaft 5. Cam projections on the bottom side of the cam plate 6 hob on the rollers of a roller ring, as indicated in FIG. 1. In this manner, the cam plate 6 and the distributor piston 4 perform a lifting movement in addition to a rotary motion. The rotary motion serves to distribute the fuel to the individual cylinders of the internal combustion engine. The lifting movement, on the other hand, is used to build up the pressure needed to inject the fuel.

The distributor piston 4 is partially seated within a cylinder bore 7 of a distributor member 8. The distributor piston 4 defines an axial bore hole 9. One end of the bore hole 9 is defined by a front inner wall 10 of the distributor piston 4. The other end of the bore hole 9 communicates with a radial bore hole 11 also defined by the distributor piston 4. A slide valve 12 is adapted to be axially displaced along the length of the distributor piston 4 by means of a regulating device 13. The slide valve 12 is adapted to be aligned relative to the radial bore hole 11 to enable an adjustable reset area 14 defined by the distributor piston 4, as shown in FIG. 2, to discharge fuel into the pump interior 15.

Figure 2:
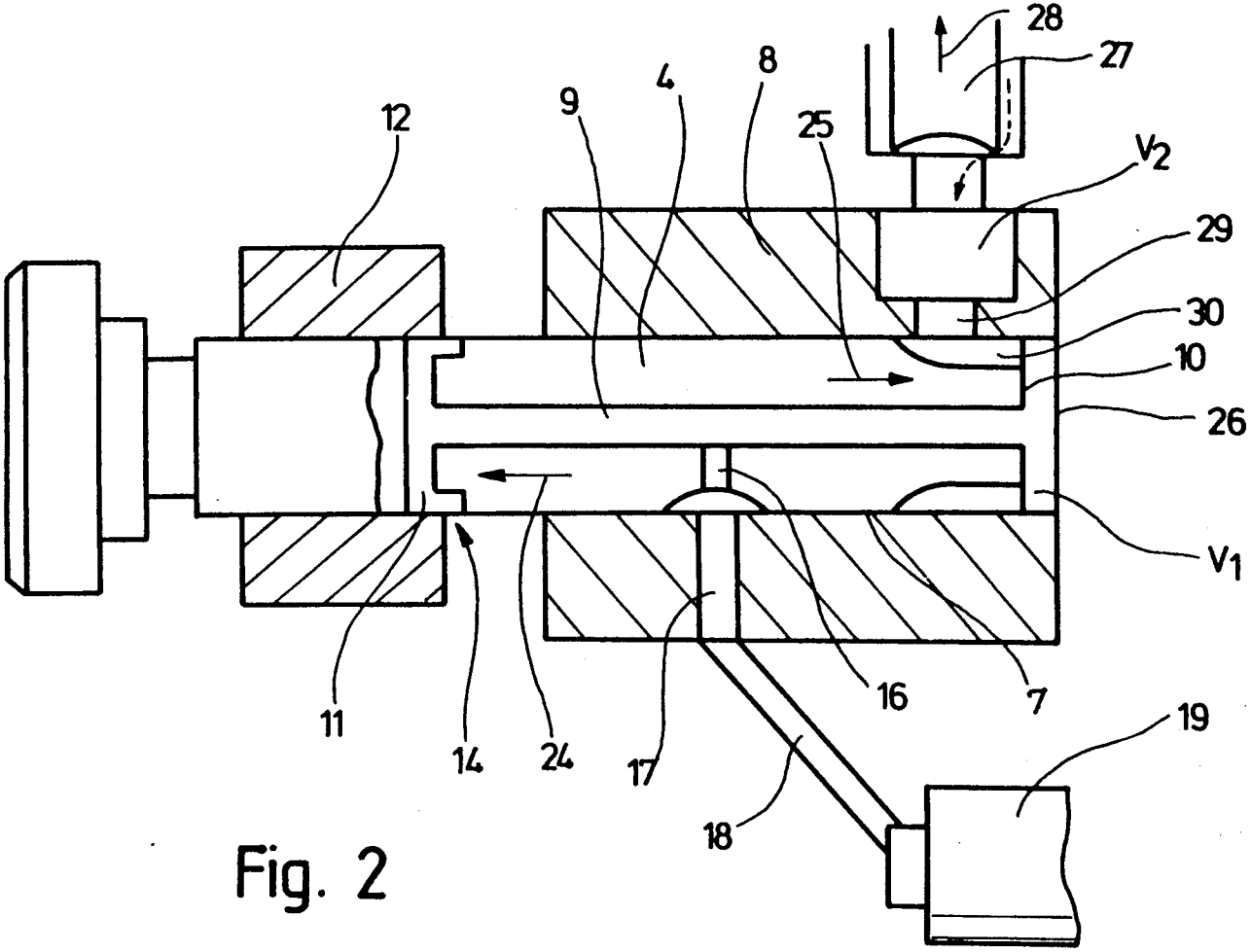
FIG. 2 is a cross-sectional view of the piston and cylinder unit of the distributor injection pump of FIG. 1.

As shown in FIG. 2, a transverse duct 16 is defined by the distributor piston 4 at about the middle of the axial bore hole 9. The transverse duct 16 is adapted to be coupled in fluid communication with several bore holes 17 (only one shown), which are each offset at an angle relative to another in the distributor member 8. Supply lines 18 are each coupled in fluid communication on a first end with a respective bore hole 17 and with a pipe connection 19 on a second end. The pipe connections 19 are in turn coupled to the corresponding injection lines (not shown) of the engine cylinders (not shown). As shown in FIG. 1, a pressure valve 20 is coupled to the second end of the supply lines 18.

As shown in FIG. 1, an electronic stopping device 21 includes a stop valve 22. The stopping device 21 is adapted to block off an ELAB outer chamber $V_2$, defined by the distributor member 8, from a fuel supply duct 23. The fuel supply duct 23 empties into the pump interior 15.

In the operation of the distributor injection pump 1, when the driving shaft 5 turns, the cam plate 6 causes the distributor piston 4 to perform both lifting and rotating motions. In FIG. 2, an arrow 24 indicates the direction of movement of the distributor piston 4 into the "bottom dead-point position" (UT position). An arrow 25, on the other hand, indicates the direction of movement of the distributor piston 4 into the "upper dead-point position" (OT position).

The distributor piston 4 is initially brought into the UT position for an injection operation. As a result, an element chamber $V_1$, which is formed between the front inner wall 10 of the distributor piston 4 and a front wall 26 of the distributor member 8, becomes enlarged. During the operation of the internal combustion engine, the valve body 27 of the stop valve 22 is displaced in the direction of an arrow 28, so that fuel can flow along the path indicated by the dotted arrow, as shown in FIG. 2. The fuel then flows into the ELAB outer chamber $V_2$ and, from there, through a passage 29 defined by the distributor member 8 and through corresponding slits 30. The slits 30 are formed in the front inner wall 10 and spaced apart from each other along the periphery of the distributor piston 4. The fuel then flows from the slits 30 into the element chamber $V_1$.

In order to build up or increase the injection pressure, the distributor piston 4 is displaced in the direction of the arrow 25 and, thus, into its OT position. As a result, the pressure in the element chamber $V_1$ increases. The fuel is therefore delivered through the axial bore hole 9, through the transverse duct 16, through the corresponding bore hole 17 and the associated supply line 18 and, in turn, into the respective cylinder of the internal combustion engine. If another cylinder is to be subsequently operated, then the operation is repeated. However, the distributor piston 4 is rotated and, thus, the transverse duct 16 interacts with another bore hole 17 of the distributor member 8.

The delivery of fuel is ended when the position of the slide valve 12 is adjusted to release the reset area 14. Thus, when the reset area 14 is released, the pressure in the element chamber $V_1$ is reduced. The excess fuel thus flows through the reset area 14 and into the pump interior 15 and, therefore, is no longer available for the injection operation. The cross-section of the reset area 14 varies with respect to time, and is dependent upon the rotational frequency, the desired end of the fuel delivery, and the configuration or form of the reset area 14.

The connection between the element chamber $V_1$ and the ELAB outer chamber $V_2$ is established relative to the lift of the cam plate 6 by setting the admission port control times and by setting the injection timing mechanism 3. This means that if the injection timing mechanism 3 has a late setting (in contrast to an early setting), then the admission port area and, thus, the connection between the element chamber $V_1$ and the ELAB outer chamber $V_2$ is opened relatively early. When the injection timing mechanism 3 has an early setting, on the other hand, the connection between the element chamber $V_1$ and the ELAB outer chamber $V_2$ is established only after the OT position of the distributor piston 4 is reached (i.e., when the distributor piston 4 is moved in the direction of the arrow 24).

In contrast, when the injection timing mechanism 3 has a late setting, the connection between the element chamber $V_1$ and the ELAB outer chamber $V_2$ is established before the OT position of the distributor piston 4 is reached. Thus, depending on the setting of the injection timing mechanism 3, the ELAB outer chamber $V_2$ is filled with fuel to a greater extent with a late setting and to a lesser extent with an early setting.

Any residual fuel remaining in the ELAB outer chamber $V_2$ after the stop valve 22 is closed prevents the internal combustion engine from being shut off immediately. In this case, depending upon the position of the slide valve 12, the residual fuel can be fed back or, that is, injected into the cylinders of the engine. At this point, the residual fuel is supplied from the pump interior 15, through the reset area 14 and, in turn, through the axial bore hole 9 (opposite the normal direction of flow). The residual fuel can therefore be injected despite the fact that the stop valve 22 is closed. This is particularly the case at low rotational frequencies of the internal combustion engine, since a larger reset area 14 is available with respect to time and the injection timing mechanism 3 is adjusted for a later injection start.

In accordance with the present invention, after the stop valve 22 is closed, the injection timing mechanism 3 is adjusted to the early setting, in order to shut off the internal combustion engine and, thus, the disadvantages typically encountered with injection pumps do not occur. The injection timing mechanism 3 is adjusted by properly setting a pulse control factor for a corresponding solenoid valve. In the early setting, the residual fuel still available for injection after the stop valve 22 is closed, is reduced. In this respect, the reliability of the preferably electronically controlled distributor injection pump 1 is increased.

Between the time that the stop valve 22 is closed and the adjustment to the early setting of the injection timing mechanism 3, there is preferably a time delay in the range of about 200 to 300 ms. The time delay ensures that the fuel quantity already available is consumed in the corresponding cylinders of the internal combustion engine before the injection timing mechanism 3 assumes its early setting. As a result, there is no harsh engine noise or accompanying mechanical stress, as typically occurs in the early setting.

As a rule, the early adjustment of the injection timing mechanism 3 takes place after the expiration of the time delay and, thus, after the instant that the stop valve 22 is closed. In this case, the delay in the shut off of the operation of the engine is minimal. If the internal combustion engine must be shut off very quickly, in an emergency, for example, then the early adjustment of the injection timing mechanism 3 is performed at the same time that the stop valve 22 is closed. Because such emergency situations are encountered infrequently, however, the resulting noise generated by the internal combustion engine can be tolerated.

I claim:

1. A method for reducing the amount of residual injection fluid within an injection pump for an internal combustion engine upon shutting off the engine, comprising the following steps:

closing a stop valve on the injection pump to cease the supply of injection fluid to the pump; and then adjusting an injection timing mechanism to an early position in order to reduce the quantity of residual injection fluid within the pump.

2. A method as defined in claim 1 wherein the injection pump is a distributor injection pump.

3. A method as defined in claim 1 wherein the injection timing mechanism is adjusted to the early position upon the expiration of a predetermined time period initiated upon the closing of the stop valve.

4. A method as defined in claim 3 wherein the predetermined time period is selected in order to permit the injection fluid already supplied to the cylinders of the internal combustion engine to be consumed in the existing position of the timing mechanism.

5. A method as defined in claim 4 wherein the predetermined time period is within the range of about 200 to 300 ms.

6. An injection pump for an internal combustion engine, comprising:

a valve adapted to be opened to permit the flow of injection fluid to the pump and to be closed to cease the flow of injection fluid to the pump in order to cease the operation of the engine; and an injection timing mechanism responsive to the operation of the valve, the injection timing mechanism being adapted to assume an early position upon the closing of the valve in order to decrease the quantity of fuel supplied to the pump.

7. An injection pump as defined in claim 6, wherein the injection timing mechanism is adapted to assume the early position upon the expiration of a predetermined time period initiated upon the closing of the valve.

8. An injection pump as defined in claim 7, wherein the predetermined time period is selected in order to permit the injection fluid already supplied to the cylinders of the engine to be consumed prior to adjusting the timing mechanism into the early position.

9. An injection pump as defined in claim 8, wherein the predetermined time period is within the range of approximately 200 to 300 ms.

* * * * *